US007994764B2

(12) United States Patent
Koleno

(10) Patent No.: US 7,994,764 B2
(45) Date of Patent: Aug. 9, 2011

(54) LOW DROPOUT VOLTAGE REGULATOR WITH HIGH POWER SUPPLY REJECTION RATIO

(75) Inventor: Rastislav Koleno, Bratislava (SK)

(73) Assignee: Semiconductor Components Industries, LLC, Phoenix, AZ (US)

( * ) Notice: Subject to any disclaimer, the term of this patent is extended or adjusted under 35 U.S.C. 154(b) by 521 days.

(21) Appl. No.: 12/268,838

(22) Filed: Nov. 11, 2008

(65) Prior Publication Data

US 2010/0117609 A1 May 13, 2010

(51) Int. Cl.
*G05F 1/575* (2006.01)

(52) U.S. Cl. ..... 323/280; 323/281

(58) Field of Classification Search ..... 323/273, 323/280, 281

See application file for complete search history.

(56) References Cited

U.S. PATENT DOCUMENTS

| | | | | |
|---|---|---|---|---|
| 6,424,205 | B1 | 7/2002 | Kadanka et al. | |
| 6,700,360 | B2 * | 3/2004 | Biagi et al. | 323/280 |
| 6,703,815 | B2 * | 3/2004 | Biagi | 323/280 |
| 6,703,816 | B2 * | 3/2004 | Biagi et al. | 323/280 |
| 2010/0117609 | A1 * | 5/2010 | Koleno | 323/273 |

* cited by examiner

*Primary Examiner* — Jeffrey Sterrett
(74) *Attorney, Agent, or Firm* — Paul J. Polansky

(57) ABSTRACT

A low dropout voltage regulator includes an error amplifier, a voltage divider, and a voltage reference/amplifier circuit. The error amplifier has first and second input terminals, a power supply terminal for receiving an input voltage, and an output terminal for providing a regulated output voltage. The voltage divider provides a feedback voltage as a predetermined fraction of said regulated output voltage. The voltage reference/amplifier circuit provides a first voltage to said first input terminal of said error amplifier that varies inversely with variations of said feedback voltage, and provides a second voltage to said second input terminal of said error amplifier that varies by substantially the same amount over temperature as variations in said first voltage.

20 Claims, 3 Drawing Sheets

LOW DROPOUT VOLTAGE REGULATOR WITH HIGH POWER SUPPLY REJECTION RATIO

FIELD OF THE DISCLOSURE

The present disclosure relates generally to power supply regulators, and more particularly relates to low dropout (LDO) voltage regulators.

BACKGROUND

There are various known types of voltage regulators for power management systems, including both linear regulators and switch mode regulators. One particularly useful type of linear voltage regulator is referred to as a low dropout (LDO) voltage regulator. LDO regulators can operate correctly even when the input voltage is only about one volt higher than the regulated output voltage, and thus LDO regulators are particularly useful for high efficiency power management systems like battery operated devices. A typical LDO regulator includes a voltage reference such as a bandgap voltage reference circuit, an error amplifier, and an output voltage divider. The error amplifier changes the output voltage to make the divided output voltage equal to the reference voltage, and typically includes a pass transistor between the input and output voltage terminals.

Bandgap voltage reference circuits provide stable references but require substantial integrated circuit area. However simpler voltage reference circuits tend to have poor power supply rejection ratio (PSRR). Moreover the resistors used by the output voltage divider to form the divided output voltage create noise, which appears in the regulated output voltage. What is needed then is a low-cost, low-noise LDO regulator with high PSRR.

BRIEF DESCRIPTION OF THE DRAWINGS

The present disclosure may be better understood, and its numerous features and advantages made apparent to those skilled in the art by referencing the accompanying drawings, in which.

The use of the same reference symbols in different drawings indicates similar or identical items.

DETAILED DESCRIPTION

Figure 1:
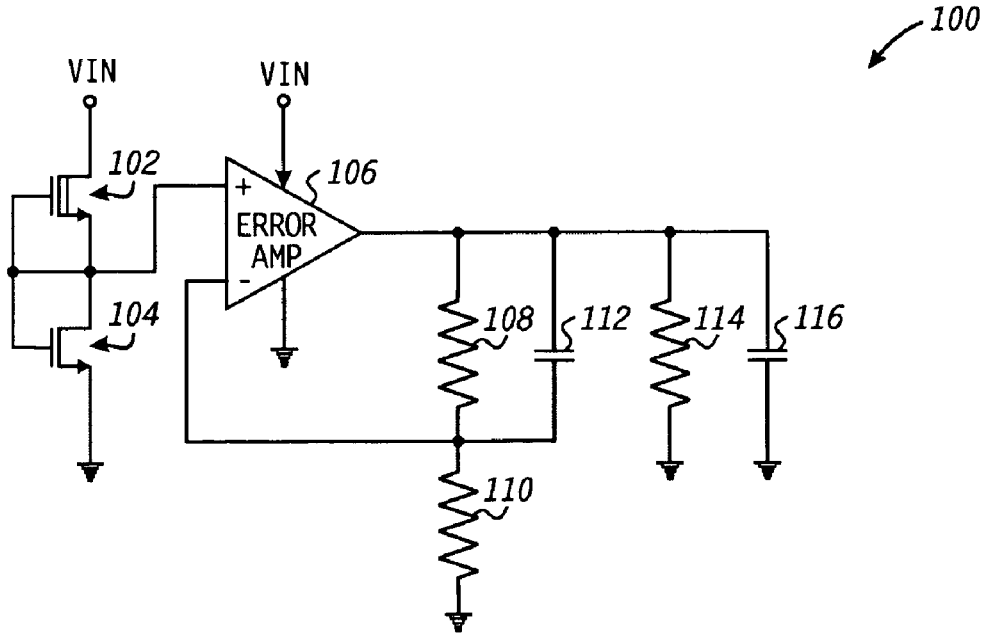
FIG. 1 (PRIOR ART)
FIG. 1 illustrates in partial block diagram and partial schematic form a low dropout voltage regulator power supply known in the prior art.

FIG. 1 illustrates in partial block diagram and partial schematic form a low dropout (LDO) voltage regulator power supply 100 known in the prior art. The LDO voltage regulator power supply 100 generally includes a depletion metal oxide semiconductor (MOS) transistor 102, an enhancement MOS transistor 104, an error amplifier 106, resistors 108, 110, and 114, and capacitors 112 and 116. Note that as used herein "MOS" transistors include transistors with polysilicon gates, as well as metal gates, as they are commonly referred to. Depletion MOS transistor 102 has a drain connected to an input power supply voltage terminal labeled "$V_{IN}$," a gate, and a source connected to the gate. Enhancement MOS transistor 104 has a drain connected to the source of depletion MOS transistor 102, a gate connected to the source of depletion MOS transistor, and a source connected to ground. Error amplifier 106 has a non-inverting input terminal connected to the source of depletion MOS transistor 102, an inverting input terminal, power supply terminals connected to $V_{IN}$ and ground, and an output terminal.

Resistor 108 has a first terminal connected to the output terminal of error amplifier 106, and a second terminal connected to the inverting input terminal of error amplifier 106. Resistor 110 has a first terminal connected to the second terminal of resistor 108, and a second terminal connected to ground. Capacitor 112 has a first terminal connected to the first terminal of resistor 108, and a second terminal connected to the second terminal of resistor 108. Resistor 114 has a first terminal connected to the first terminal of capacitor 112, and a second terminal connected to ground. Capacitor 116 has a first terminal connected to the first terminal of resistor 114, and a second terminal connected to ground.

In operation, error amplifier 106 receives a reference voltage and a feedback voltage, and provides a regulated output voltage to resistor 114 and capacitor 116 in response to a difference between the reference voltage and the feedback voltage. Connecting the gate and source of depletion MOS transistor 102 together configures depletion MOS transistor 102 as a constant current source. The gate and source of enhancement MOS transistor 104 are connected together to form a diode connected transistor. The voltage on the gate of enhancement MOS transistor 104 and thus the drain of enhancement MOS transistor is set according to a threshold voltage of enhancement MOS transistor 104. The series combination of depletion MOS transistor 102 and enhancement MOS transistor 104 creates a voltage reference which provides a stabilized voltage to the non-inverting input terminal of error amplifier 106.

The feedback voltage is applied to the inverting terminal of error amplifier 106. The feedback voltage is a stepped down voltage of the output voltage from the error amplifier 106, and the feedback voltage is based on a voltage divider created by resistors 108 and 110. Capacitor 112 is used to decrease the noise contributions of error amplifier 106, resistors 108 and 110, and MOS transistors 102 and 104 above a cutoff frequency of a resistor/capacitor (RC) network formed by resistor 108 and capacitor 112. Error amplifier 106 uses the voltage provided to the non-inverting terminal and the feedback voltage provided to the inverting terminal to provide a regulated output voltage to resistor 114 and capacitor 116. However, noise contributions from depletion MOS transistor 102, enhancement MOS transistor 104, error amplifier 106, and resistors 108 and 110 combine to create a high amount of noise. Additionally, the power supply rejection ratio (PSRR) of the voltage reference, created by depletion MOS transistor 102 and enhancement MOS transistor 104, and thus LDO voltage regulator power supply 100 is poor due to the simplicity of the voltage reference.

Figure 2:
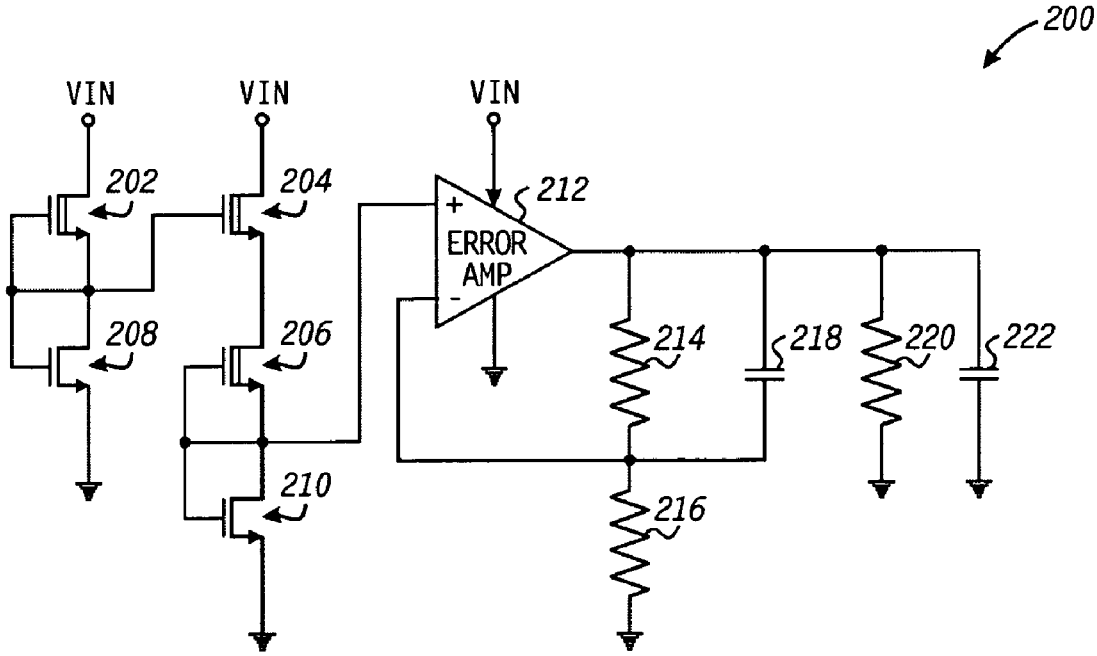
FIG. 2 (PRIOR ART)
FIG. 2 illustrates in partial block diagram and partial schematic form an alternative low dropout voltage regulator power supply known in the prior art.

FIG. 2 illustrates in partial block diagram and partial schematic form an alternative LDO voltage regulator power supply 200 known in the prior art. LDO voltage regulator power supply 200 generally includes depletion MOS transistors 202, 204, and 206, enhancement MOS transistors 208 and 210, an error amplifier 212, resistors 214, 216, and 220, and capacitors 218 and 222. Depletion MOS transistor 202 has a drain connected to $V_{IN}$, a gate, and a source connected to the gate. Enhancement MOS transistor 208 has a drain connected to the source of depletion MOS transistor 202, a gate connected to the source of depletion MOS transistor 202, and a source connected to ground. Depletion MOS transistor 204 has a drain connected to the input voltage, $V_{IN}$, a gate connected to the source of depletion MOS transistor 202, and a source. Depletion MOS transistor 206 has a drain connected to the source of depletion MOS transistor 204, a gate, and a source connected to the gate. Enhancement MOS transistor 210 has a drain connected to the source of depletion MOS transistor 206, a gate connected to the source of depletion MOS transistor 206, and a source connected ground.

Error amplifier 212 has a non-inverting input terminal connected to the source of depletion MOS transistor 206, an inverting input terminal, power supply terminals connected to $V_{IN}$ and ground, and an output terminal. Resistor 214 has a first terminal connected to the output terminal of error amplifier 212, and a second terminal connected to the inverting input terminal of error amplifier 212. Resistor 216 has a first terminal connected to the second terminal of resistor 214, and a second terminal connected to ground. Capacitor 218 has a first terminal connected to the first terminal of resistor 214, and a second terminal connected to the second terminal of resistor 214. Resistor 220 has a first terminal connected to the first terminal of capacitor 218, and a second terminal connected to ground. Capacitor 222 has a first terminal connected to the first terminal of resistor 220, and a second terminal connected to ground.

In operation, LDO voltage regulator power supply 200 provides a regulated voltage reference based on a stable reference voltage provided to the non-inverting terminal and a feedback voltage provided to the inverting terminal of the error amplifier 212. Connecting the gate and source terminals of depletion MOS transistor 202 together configures depletion MOS transistor 202 as a constant current source. The gate and drain terminals of enhancement MOS transistor 208 are connected together to form a diode connected transistor. The voltage existing on the gate terminal of enhancement MOS transistor 208, and therefore also on the drain terminal of enhancement MOS transistor 208, is set according to the threshold voltage of enhancement MOS transistor 208. The voltage generated at the drain of enhancement MOS transistor 208 is dependent upon the threshold voltage of enhancement MOS transistor 208 and is therefore substantially independent of the input voltage $V_{IN}$. The series combination of depletion MOS transistor 202 and enhancement MOS transistor 208, provides a stabilized voltage to the gate of depletion MOS transistor 204.

Depletion MOS transistor 204 functions as a high input impedance buffer accepting the pre-stabilized voltage output from depletion MOS transistor 202 and enhancement MOS transistor 208, and supplying a buffered stabilized voltage to the drain of depletion MOS transistor 206. Depletion MOS transistor 204 is configured as a source follower whereby the voltage on the source terminal of depletion MOS transistor 204 tracks the voltage present on the gate terminal of depletion MOS transistor 204. Depletion MOS transistor 204 is largely unaffected by any change in the input voltage $V_{IN}$ due to the source follower characteristics of depletion MOS transistor 204 and therefore substantially increases the PSRR performance of LDO voltage regulator power supply 200 over LDO voltage regulator power supply 100.

The voltage on the source terminal of depletion MOS transistor 204 supplies potential to the drain terminal of depletion MOS transistor 206. Depletion MOS transistor 206 provides a source of constant current to enhancement MOS transistor 210. Enhancement MOS transistor 210 is diode connected to provide a constant voltage equal to the threshold voltage of enhancement MOS transistor 210. The voltage at the source of depletion MOS transistor 206 is provided to the non-inverting input terminal of error amplifier 212.

The feedback voltage is applied to the inverting terminal of error amplifier 212. The feedback voltage is a stepped down voltage of the output voltage from the error amplifier 212, and the feedback voltage is based on a voltage divider created by resistors 214 and 216. Capacitor 218 is used to decrease the noise contributions of error amplifier 212, resistors 214 and 216, and MOS transistors 210 and 206 above a cutoff frequency of a resistor/capacitor (RC) network formed by resistor 214 and capacitor 218. Error amplifier 212 uses the voltage provided to the non-inverting terminal and the feedback voltage provided to the inverting terminal to output a regulated output voltage to resistor 220 and capacitor 222. However, noise contributions from depletion MOS transistors 202, 204, and 206, enhancement MOS transistors 208 and 210, error amplifier 212, and resistors 214 and 216 combine to create a high amount of noise.

Figure 3:
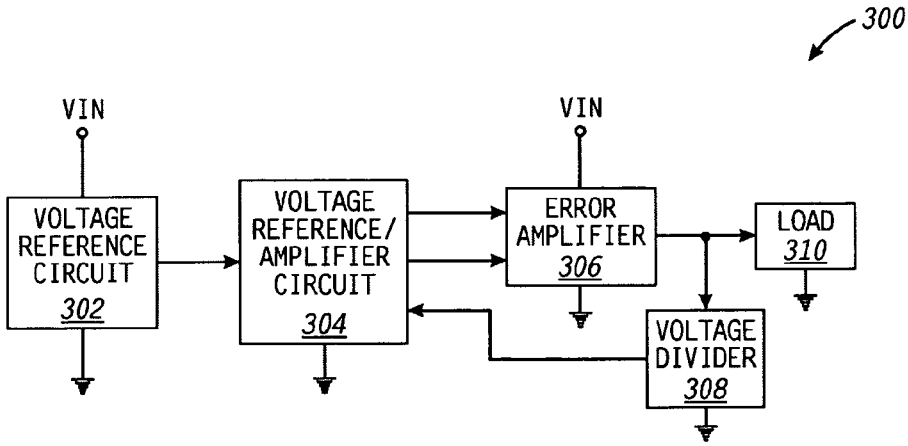
FIG. 3 illustrates in block diagram form a low dropout voltage regulator power supply according to the present invention.

FIG. 3 illustrates in block diagram form a LDO voltage regulator power supply 300 according to the present invention. The LDO voltage regulator power supply 300 generally includes a voltage reference circuit 302, a voltage reference/amplifier circuit 304, an error amplifier 306, a voltage divider 308, and a load 310. Voltage reference circuit 302 has a power supply terminal connected between $V_{IN}$ and ground, and an output terminal for providing a reference voltage. Voltage reference/amplifier circuit 304 has a first input terminal connected to the output terminal of the voltage reference circuit 302, a second input terminal, a power supply terminal connected to ground, and first and second output terminals.

Error amplifier 306 has a first input terminal connected to the first output terminal of voltage reference/amplifier circuit 304, a second input terminal connected to the second output terminal of voltage reference/amplifier circuit 304, a power supply terminal for receiving the input voltage, $V_{IN}$, and an output terminal. LDO voltage regulator power supply 300 can be designed for use with MOS technology, thus error amplifier 306 is characterized as being an error amplifier with a MOS input differential stage. In another embodiment, error amplifier 306 can be implemented using bipolar transistors, thus error amplifier 306 is characterized as being an error amplifier with a bipolar input differential stage. Voltage divider 308 has an input terminal connected to the output terminal of error amplifier 306, and an output terminal connected to the second input terminal of voltage reference/amplifier circuit 304. Load 310 is connected between the output terminal of error amplifier 306 and ground.

In operation, error amplifier 306 provides a regulated output voltage to load 310 based on a voltage from voltage reference/amplifier 304 and a feedback voltage from voltage divider 308. Error amplifier 306 includes an internal pass device, not shown in FIG. 3, to provide low dropout operation. Voltage reference circuit 302 provides a reference voltage to voltage reference/amplifier circuit 304. Voltage divider 308 provides a feedback voltage as a predetermined fraction of the regulated output voltage to voltage reference/amplifier circuit 304. Voltage reference/amplifier circuit 304 provides a first voltage to the first input terminal of error amplifier 306 that varies inversely with variations of the feedback voltage. Additionally, voltage reference/amplifier circuit 304 provides a second voltage to the second input terminal of error amplifier 306 that varies by substantially the same amount over temperature as variations in the first voltage. In another embodiment, voltage reference/amplifier circuit 304 can provide the second voltage as a voltage reference to the second input terminal of error amplifier 306.

Voltage reference circuit 302 creates a high PSRR for LDO voltage regulator power supply 300 by providing a stable voltage reference that is substantially unaffected by changes in input voltage $V_{IN}$. Additionally, the gain of voltage reference/amplifier circuit 304 suppresses the noise created by error amplifier 306. Thus, the only noise created in LDO voltage regulator power supply 300 results from voltage reference/amplifier circuit 304, and from voltage divider 308. Thus, LDO voltage regulator power supply 300 provides the regulated output voltage while having a high PSRR and a low amount of noise.

Figure 4:
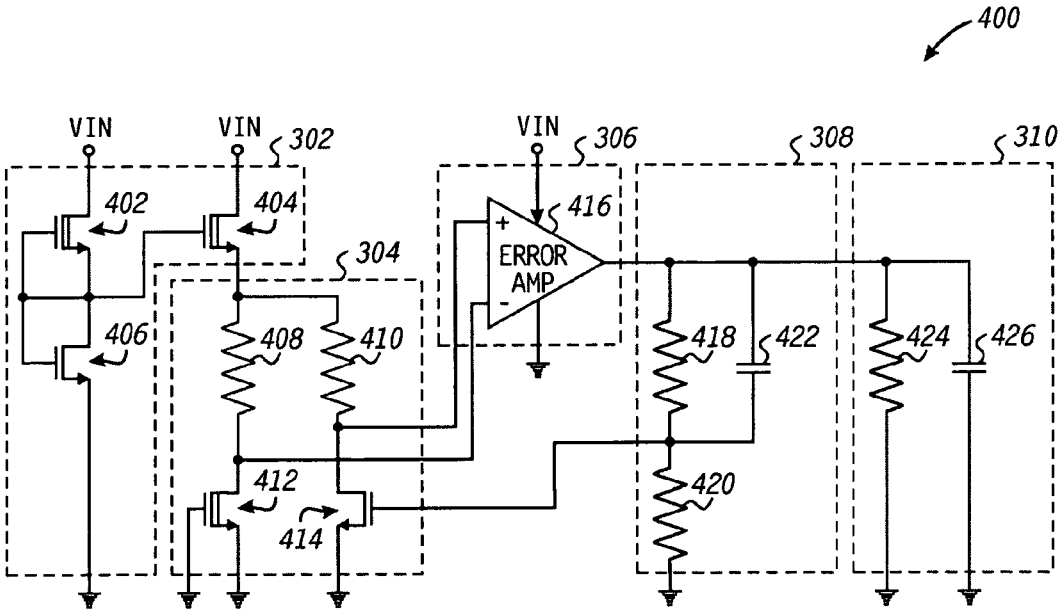
FIG. 4 illustrates in partial block diagram and partial schematic form the low dropout voltage regulator power supply of FIG. 3.

FIG. 4 illustrates in partial block diagram and partial schematic form a circuit implementation 400 of LDO voltage regulator power supply 300 of FIG. 3. LDO voltage regulator power supply 400 generally includes voltage reference circuit 302, voltage reference/amplifier circuit 304, error amplifier 306, voltage divider 308, and load 310 shown in FIG. 4 in greater detail. Voltage reference circuit 302 includes depletion MOS transistors 402 and 404, and an enhancement MOS transistor 406. Depletion MOS transistor 402 has a drain connected to $V_{IN}$, a gate, and a source connected to the gate. Enhancement MOS transistor 406 has a drain connected to the source of depletion MOS transistor 402, a gate connected to the source of depletion MOS transistor 402, and a source connected ground. Depletion MOS transistor 404 has a drain connected to $V_{IN}$ a gate connected to the source of depletion MOS transistor 402, and a source.

Voltage reference/amplifier circuit 304 includes resistors 408 and 410, a depletion MOS transistor 412, and an enhancement MOS transistor 414. Resistor 408 has a first terminal connected to the source of depletion MOS transistor 404, and a second terminal. Resistor 410 has a first terminal connected to the first terminal of resistor 408 and a second terminal. Depletion MOS transistor 412 has a drain connected to the second terminal of resistor 408, a gate connected to ground, and a source connected to ground. Enhancement MOS transistor 414 has a drain connected to the second terminal of resistor 410, a gate, and a source connected to ground.

Error amplifier 306 includes an error amplifier 416 having a non-inverting input terminal connected to the second terminal of resistor 410, an inverting input terminal connected to the second terminal of resistor 408, an input voltage terminal connected to $V_{IN}$ and an output terminal.

Voltage divider 308 includes resistors 418 and 420, and a capacitor 422. Resistor 418 has a first terminal connected to the output terminal of error amplifier 416, and a second terminal connected to the gate of enhancement MOS transistor 414. Resistor 420 has a first terminal connected to the second terminal of resistor 418, and a second terminal connected to ground. Capacitor 422 has a first terminal connected to the first terminal of resistor 418, and a second terminal connected to the second terminal of resistor 418.

Load 310 includes a resistor 424 and a capacitor 426. Resistor 424 has a first terminal connected to the first terminal of capacitor 422, and a second terminal connected to ground. Capacitor 426 has a first terminal connected to the first terminal of resistor 424, and a second terminal connected to ground.

In operation, error amplifier 416 provides a regulated output voltage to resistor 424 and capacitor 426 of load 310 based on two voltages from voltage reference/amplifier circuit 304. Error amplifier 306 includes an internal pass device, not shown in FIG. 4, to provide low dropout operation. Error amplifier 416 is implemented using MOS transistors, but in an alternate embodiment could be formed with bipolar transistors. Connecting the gate and source terminals of depletion MOS transistor 402 together configures depletion MOS transistor 402 as a constant current source. The gate and drain terminals of enhancement MOS transistor 406 are connected together to form a diode connected transistor. The voltage existing on the gate terminal of enhancement MOS transistor 406, and therefore also on the drain terminal of enhancement MOS transistor 406, is set according to the threshold voltage of enhancement MOS transistor 406. The voltage at the gate terminal of depletion MOS transistor 402 is therefore set by the threshold voltage of enhancement MOS transistor 406. The voltage generated at the drain of enhancement MOS transistor 406 is dependent upon the threshold voltage of enhancement MOS transistor 406 and is therefore substantially independent of the input voltage $V_{IN}$. The series combination of depletion MOS transistor 402 and enhancement MOS transistor 406, provides a stabilized voltage to the gate of depletion MOS transistor 404.

Depletion MOS transistor 404 is a high input impedance buffer accepting the pre-stabilized voltage output from depletion MOS transistor 402 and enhancement MOS transistor 406, and supplying a buffered stabilized voltage to resistors 408 and 410. Depletion MOS transistor 404 is configured as a source follower whereby the voltage on the source terminal of depletion MOS transistor 404 tracks the voltage present on the gate terminal of depletion MOS transistor 404. Depletion MOS transistor 404 is largely unaffected by any change in $V_{IN}$ due to the source follower characteristics of depletion MOS transistor 404 and therefore substantially increases the PSRR performance of LDO voltage regulator power supply 400.

Based on the gate and the source of depletion MOS transistor 412 being connected to ground, MOS transistor 412 creates a reference current in voltage reference/amplifier circuit 304. A reference voltage is created based on the reference current being conducted through resistor 408, and the reference voltage is provided to the inverting input terminal of error amplifier 416. The feedback voltage is applied to the gate of enhancement MOS transistor 414. The feedback voltage is a stepped down voltage of the output voltage from the error amplifier 416, and the feedback voltage is based on a voltage divider created by resistors 418 and 420. Capacitor 422 is used to decrease the noise contributions of resistors 418 and 420, and MOS transistors 412 and 414 above a cutoff frequency of a resistor/capacitor (RC) network formed by resistor 422 and capacitor 418.

Based on the feedback provided to the gate of enhancement transistor 414, a variable current is conducted through enhancement MOS transistor 414. As the feedback voltage increases, enhancement MOS transistor 414 becomes more conductive and as a result more current is conducted through enhancement MOS transistor 414. The variable current conducted through enhancement MOS transistor 414 is also conducted through resistor 410, creating a voltage at the second terminal of resistor 410. The voltage at the second terminal of resistor 410 is provided to the non-inverting input terminal of error amplifier 416, and the voltage varies inversely with variations of the feedback voltage. For example, the higher the feedback voltage, the more current conducted through the resistor 410, and the more current conducted through resistor 410 causes a greater voltage drop across resistor 410, such that the voltage applied to the non-inverting input terminal of error amplifier 416 is reduced.

The physical characteristics of depletion MOS transistor 412 and enhancement MOS transistor 414 can be designed such that the voltages provided to error amplifier 416 vary by substantially the same amount over an expected operating temperature range of LDO voltage reference power supply 400, while the gate voltage of the enhancement MOS transistor 414 remains almost constant over expected operating temperature range. Error amplifier 416 regulates the output voltage provided to resistor 424 and capacitor 426 of load 310, such that the voltages applied to the non-inverting input terminal and the inverting input terminal are substantially equal. Thus, as the regulated output voltage changes, the feedback voltage and the voltage applied to the non-inverting input terminal of error amplifier 416 also change. A gain configuration of depletion MOS transistor 412, enhancement MOS transistor 414, and resistors 408 and 410 can be designed such that the noise produced by the output of error amplifier is suppressed. Thus, the noise of LDO voltage regulator power supply 400 is substantially limited to the noise from depletion MOS transistor 412, enhancement MOS transistor 414, and the noise of voltage divider 308. Therefore, LDO voltage regulator power supply 400 has a high PSRR and a low amount of noise.

Figure 5:
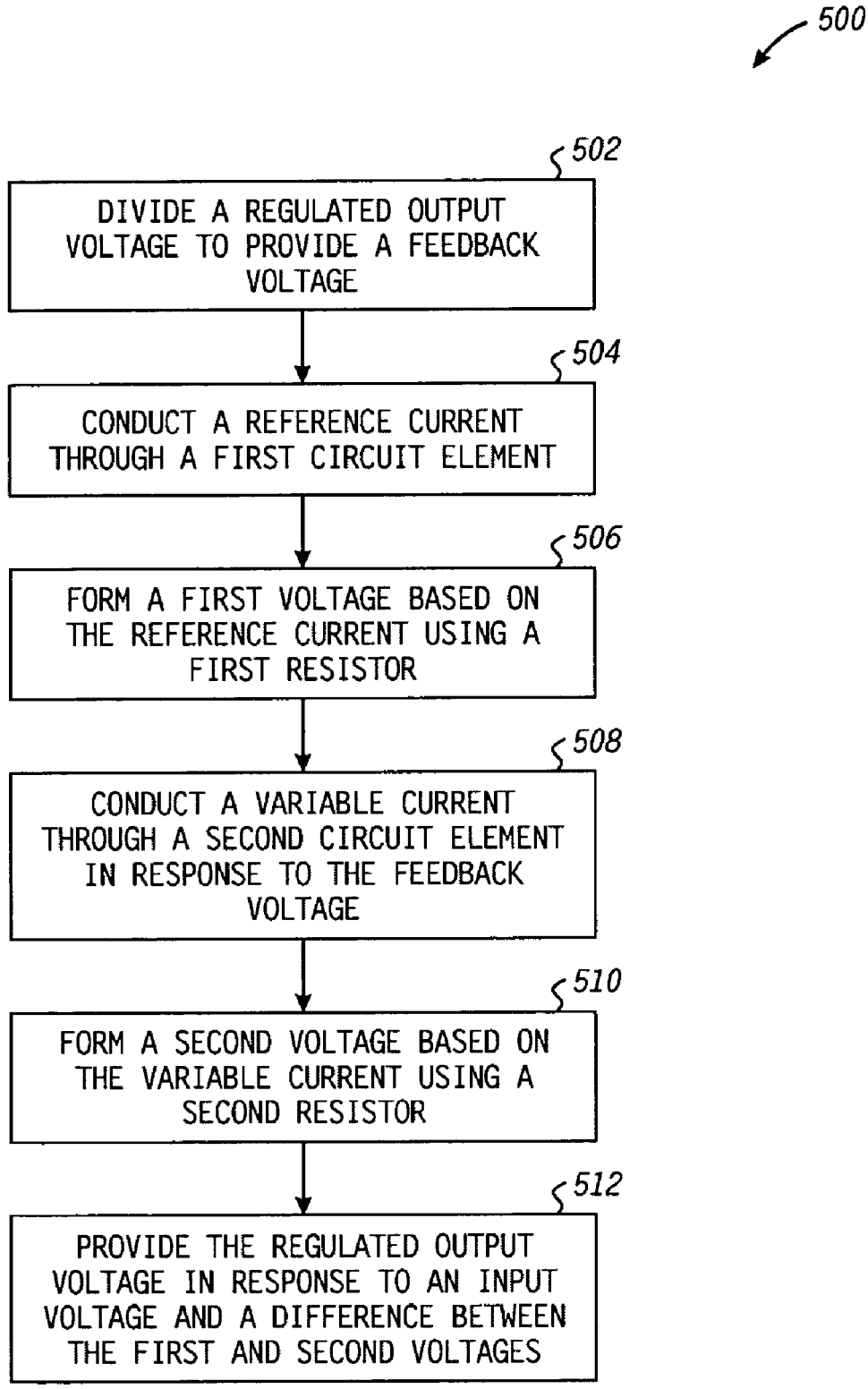
FIG. 5 illustrates a flow diagram of a method for providing a regulated output voltage in the low dropout voltage regulator power supply of FIG. 3.

FIG. 5 illustrates a flow diagram of a method 500 for providing a regulated output voltage in LDO voltage regulator power supply 300 of FIG. 3. At block 502, a regulated output voltage is divided to provide a feedback voltage. A reference current is conducted through a first circuit element at block 504. At block 506, a first voltage is formed based on the reference current and using a first resistor. A variable current is conducted through a second circuit element in response to the feedback voltage at block 508. At block 510, a second voltage is formed based on the variable current and using a second resistor. The regulated output voltage is provided in response to an input voltage and a difference between the first and second voltages.

The above-disclosed subject matter is to be considered illustrative, and not restrictive, and the appended claims are intended to cover all such modifications, enhancements, and other embodiments that fall within the true scope of the claims. Thus, to the maximum extent allowed by law, the scope of the present invention is to be determined by the broadest permissible interpretation of the following claims and their equivalents, and shall not be restricted or limited by the foregoing detailed description.

What is claimed is:

1. A low dropout voltage regulator, comprising:

a voltage reference circuit having an output for providing a reference voltage;

an error amplifier having first and second input terminals, a power supply terminal for receiving an input voltage, and an output terminal for providing a regulated output voltage;

a voltage divider for providing a feedback voltage as a predetermined fraction of said regulated output voltage; and a voltage reference/amplifier circuit coupled to said first and second input terminals of said error amplifier and to said voltage divider, said voltage reference/amplifier circuit comprising:

a first resistor having a first terminal for receiving said reference voltage, and a second terminal coupled to said first input terminal of said error amplifier;

a second resistor having a first terminal for receiving said reference voltage, and a second terminal coupled to said second input terminal of said error amplifier;

a first depletion MOS transistor having a first current electrode coupled to said second terminal of said first resistor, a gate coupled to a power supply voltage terminal, and a second current electrode coupled to said power supply voltage terminal; and a first enhancement MOS transistor having a first current electrode coupled to said second terminal of said second resistor, a gate for receiving said feedback voltage, and a second current electrode coupled to said power supply voltage terminal.

2. The low dropout voltage regulator of claim 1 wherein said error amplifier is characterized as being an error amplifier with MOS input differential stage.

3. The low dropout voltage regulator of claim 1 wherein said error amplifier is characterized as being an error amplifier with bipolar input differential stage.

4. The low dropout voltage regulator of claim 1, wherein said voltage reference circuit comprises:

a second depletion MOS transistor having a first current electrode for receiving said input voltage, a gate, and a second current electrode coupled to said gate;

a second enhancement MOS transistor having a first current electrode coupled to said second current electrode of said second depletion MOS transistor, a gate coupled to said second current electrode of said second depletion MOS transistor, and a second current electrode coupled to said power supply voltage terminal; and a third depletion MOS transistor having a first current electrode for receiving said input voltage, a gate coupled to said second current electrode of said second depletion MOS transistor, and a second current electrode for providing said reference voltage.

5. The low dropout voltage regulator of claim 1 wherein said first input terminal of said error amplifier is inverting and said second input terminal of said error amplifier is non-inverting.

6. The low dropout voltage regulator of claim 1, further comprising:

a load having an input terminal for receiving said regulated output voltage.

7. The low dropout voltage regulator of claim 1, wherein said voltage divider comprises a capacitor.

8. A low dropout voltage regulator, comprising:

an error amplifier having first and second input terminals, a power supply terminal for receiving an input voltage, and an output terminal for providing a regulated output voltage;

a voltage divider for providing a feedback voltage as a predetermined fraction of said regulated output voltage; and an amplifier circuit for providing a first voltage to said first input terminal of said error amplifier that varies inversely with variations of said feedback voltage, and providing a second voltage to said second input terminal of said error amplifier that varies by substantially the same amount over temperature as variations in said first voltage.

9. The low dropout voltage regulator of claim 8 wherein said error amplifier is characterized as being an error amplifier with MOS input differential stage.

10. The low dropout voltage regulator of claim 8 wherein said amplifier circuit is characterized as being a reference voltage/amplifier circuit, wherein said second voltage is characterized as being a reference voltage.

11. The low dropout voltage regulator of claim 10, wherein said amplifier circuit comprises:

a first resistor having a first terminal for receiving a reference voltage, and a second terminal coupled to said first input terminal of said error amplifier;

a second resistor having a first terminal for receiving said reference voltage, and a second terminal coupled to said second input terminal of said error amplifier;

a depletion MOS transistor having a first current electrode coupled to said second terminal of said first resistor, a gate coupled to a power supply voltage terminal, and a second current electrode coupled to said power supply voltage terminal; and an enhancement MOS transistor having a first current electrode coupled to said second terminal of said second resistor, a gate for receiving said feedback voltage, and a second current electrode coupled to said power supply voltage terminal.

12. The low dropout voltage regulator of claim 8, further comprising:

a voltage reference circuit having an output for providing a reference voltage;

said voltage reference circuit comprising:

a first depletion MOS transistor having a first current electrode for receiving said input voltage, a gate, and a second current electrode coupled to said gate;

an enhancement MOS transistor having a first current electrode coupled to said second current electrode of said first depletion MOS transistor, a gate coupled to said second current electrode of said first depletion MOS transistor, and a second current electrode coupled to a power supply voltage terminal; and a second depletion MOS transistor having a first current electrode for receiving said input voltage, a gate coupled to said second current electrode of said first depletion MOS transistor, and a second current electrode for providing said reference voltage.

13. The low dropout voltage regulator of claim 8 said first input terminal of said error amplifier is non-inverting and said second input terminal of said error amplifier is inverting.

14. The low dropout voltage regulator of claim 8, further comprising:

a load having an input terminal for receiving said regulated output voltage.

15. The low dropout voltage regulator of claim 8, wherein said voltage divider comprises a capacitor.

16. A method for use in a low drop voltage regulator that provides a regulated output voltage comprising:

dividing the regulated output voltage to provide a feedback voltage;

conducting a reference current through a first circuit element;

forming a first voltage based on said reference current using a first resistor;

conducting a variable current through a second circuit element in response to said feedback voltage;

forming a second voltage based on said variable current using a second resistor; and providing the regulated output voltage in response to an input voltage and a difference between said first and second voltages.

17. The method of claim 16 wherein said conducting said reference current comprises conducting said reference current through a depletion MOS transistor.

18. The method of claim 16 wherein said conducting said variable current comprises conducting said variable current through an enhancement MOS transistor.

19. The method of claim 16 wherein said providing the regulated output voltage comprises providing the regulated output voltage from an error amplifier with MOS input differential stage.

20. The method of claim 16 wherein said providing the regulated output voltage comprises providing the regulated output voltage from an error amplifier with bipolar input differential stage.

* * * * *